US011314270B2

(12) United States Patent
Hino

(10) Patent No.: US 11,314,270 B2
(45) Date of Patent: Apr. 26, 2022

(54) CONSTANT VOLTAGE GENERATOR CIRCUIT PROVIDED WITH OPERATIONAL AMPLIFIER INCLUDING FEEDBACK CIRCUIT

(71) Applicant: NISSHINBO MICRO DEVICES INC., Tokyo (JP)

(72) Inventor: Takahiro Hino, Osaka (JP)

(73) Assignee: NISSHINBO MICRO DEVICES INC., Tokyo (JP)

( * ) Notice: Subject to any disclaimer, the term of this patent is extended or adjusted under 35 U.S.C. 154(b) by 0 days.

(21) Appl. No.: 17/253,725

(22) PCT Filed: Jun. 27, 2018

(86) PCT No.: PCT/JP2018/024424

§ 371 (c)(1),
(2) Date: Dec. 18, 2020

(87) PCT Pub. No.: WO2020/003419

PCT Pub. Date: Jan. 20, 2020

(65) Prior Publication Data

US 2021/0191442 A1 Jun. 24, 2021

(51) Int. Cl.

| | |
|---|---|
| ***G05F 1/575*** | (2006.01) |
| ***G05F 1/46*** | (2006.01) |
| ***G05F 1/445*** | (2006.01) |

(52) U.S. Cl.

CPC ..... *G05F 1/575* (2013.01); *G05F 1/445* (2013.01); *G05F 1/461* (2013.01); *G05F 1/467* (2013.01)

(58) Field of Classification Search

CPC . G05F 1/575; G05F 1/56; G05F 1/445; G05F 1/461; G05F 1/466–467

See application file for complete search history.

(56) References Cited

U.S. PATENT DOCUMENTS 5,587,629 A * 12/1996 Gornstein ..... H05B 41/30 315/200 R
2003/0235058 A1 12/2003 Toyoshima et al.
(Continued)

FOREIGN PATENT DOCUMENTS

JP 2005-316799 A 11/2005
JP 2007-11972 A 1/2007
(Continued)

OTHER PUBLICATIONS

International Preliminary Examination Report On Patentability (in English language) dated Jan. 7, 2021 in connection with International Patent Application No. PCT/JP2018/024424.
(Continued)

*Primary Examiner* — Sisay G Tiku
(74) *Attorney, Agent, or Firm* — Paul Teng

(57) ABSTRACT

A constant voltage generator circuit is provided with an operational amplifier including a feedback circuit having a first resistor, and an output transistor. The operational amplifier generates a feedback voltage generated by dividing an output voltage between an output terminal and a substrate voltage potential of the constant voltage generator circuit by the first resistor and a second resistor. Then, the operational amplifier is configured to amplify a voltage potential difference between a predetermined reference voltage and the feedback voltage and to output a control voltage. The output transistor controls an output voltage based on the control voltage from the operational amplifier, and the feedback circuit is further configured to superimpose high-frequency noise components from the substrate voltage potential onto the feedback voltage.

4 Claims, 13 Drawing Sheets

(56) References Cited

U.S. PATENT DOCUMENTS

| | | | | |
|---|---|---|---|---|
| 2005/0248325 | A1* | 11/2005 | Adachi | G05F 1/575 323/273 |
| 2007/0001656 | A1 | 1/2007 | Shimizu | |
| 2012/0025912 | A1* | 2/2012 | Oomori | H03F 3/45475 330/257 |
| 2019/0305739 | A1* | 10/2019 | Joo | H03F 3/21 |
| 2020/0125126 | A1* | 4/2020 | Gupta | G05F 1/59 |

FOREIGN PATENT DOCUMENTS

| | | | |
|---|---|---|---|
| JP | 2007-188533 | A | 7/2007 |
| JP | 2013-45834 | A | 3/2013 |
| JP | 2015-146092 | A | 8/2015 |
| JP | 2017-068471 | A | 4/2017 |

OTHER PUBLICATIONS

International Search Report (and English translation) dated Aug. 7, 2018 for counterpart International Patent Application No. PCT/JP2018/024424 filed Jun. 27, 2018.

Dec. 2, 2021 official actionof CNIPA in connection with counterpart Chinese Patent Application No. 201880095050.9.

* cited by examiner

CONSTANT VOLTAGE GENERATOR CIRCUIT PROVIDED WITH OPERATIONAL AMPLIFIER INCLUDING FEEDBACK CIRCUIT

TECHNICAL FIELD

The present invention relates to a constant voltage generator circuit including, for example, a differential amplifier circuit having a feedback circuit.

BACKGROUND ART

It has been reported that, when high-frequency radio waves are applied to an integrated circuit (hereinafter referred to as an IC), noise of the radio waves is applied to an IC terminal, causing a malfunction. In a constant voltage generator circuit including a differential amplifier circuit having a general feedback circuit, the loop frequency of a feedback system is several hundred kHz, and is about several MHz even in a circuit that can operate in high speed.

In the feedback circuit of the constant voltage generator circuit, when a high-frequency alternative current (AC) signal outside the loop frequency band is inputted, and the difference is generated in the amplitudes of the AC signal propagating to an inverting input and a non-inverting input of the differential amplifier circuit, it has been reported that the input is converted as a direct current (DC) offset voltage. It has been already known that this leads to the malfunction of the IC.

SUMMARY OF THE INVENTION

Problems to be Solved by the Invention

However, there has been such a problem that, in the constant voltage generator circuit including the differential amplifier circuit having the feedback circuit, when the noise is superimposed on a power supply, ground voltage potential, or output, the difference is generated in the propagated noise amplitude between the inverting input and the non-inverting input due to a difference in impedance of elements connected to the inverting input and the non-inverting input of the differential amplifier circuit. Then, as a result, the differential amplifier generates the DC offset and causes the malfunction.

In addition, in particular, in the case of using a phase compensation capacitance in the feedback circuit of the differential amplifier circuit in order to ensure the stability of the feedback system, when the high-frequency noise components are superimposed on the substrate voltage potential, power supply, or output, there has been a possibility of greatly deteriorating the noise immunity.

An object of the present invention is to solve the above problems, and to provide a constant voltage generator circuit that can prevent the DC offset from generating even when high-frequency noise components outside the loop frequency band of a feedback circuit is inputted in a constant voltage generator circuit including a differential amplifier circuit having a feedback circuit.

Solutions to Problems

According to one aspect of the present invention, there is provided a constant voltage generator circuit including an operational amplifier including a feedback circuit having a first resistor, and an output transistor. The operational amplifier generates a feedback voltage generated by dividing an output voltage between an output terminal and a substrate voltage potential of the constant voltage generator circuit by the first resistor and a second resistor. The operational amplifier is configured to amplify a voltage potential difference between a predetermined reference voltage and the feedback voltage and to output a control voltage. The output transistor controls an output voltage based on the control voltage from the operational amplifier. The feedback circuit is further configured to superimpose high-frequency noise components from the substrate voltage potential.

Effect of the Invention

Therefore, according to the constant voltage generator circuit of the present invention, even when the high-frequency noise components outside the loop frequency band of the feedback circuit are inputted in the constant voltage generator circuit including the differential amplifier circuit having the feedback circuit, the DC offset can be prevented from generating.

MODE FOR CARRYING OUT THE INVENTION

Figure 1:
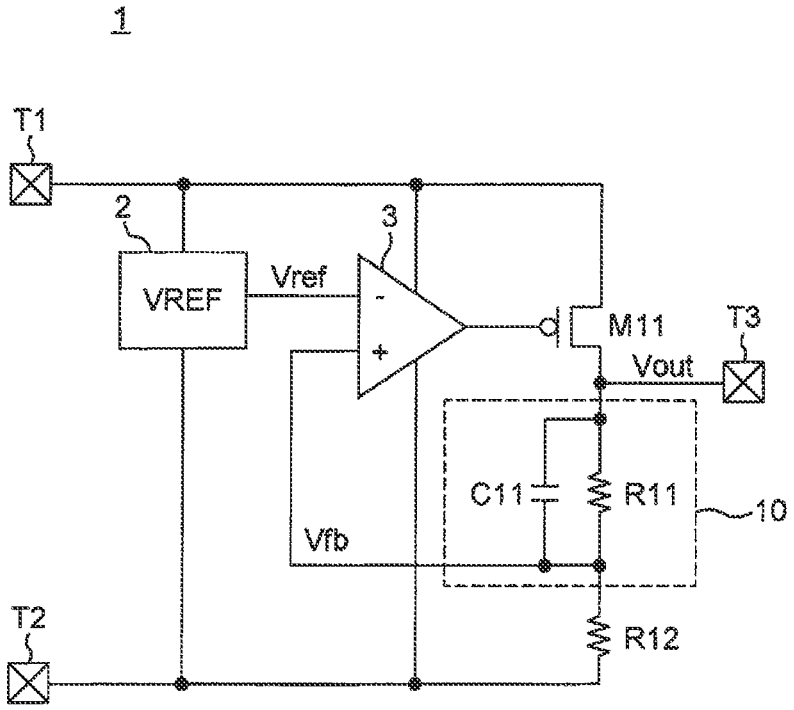
FIG. 1 is a circuit diagram showing a configuration of a constant voltage generator circuit 1 according to a comparative example.

Hereinafter, a comparative example and embodiments according to the present invention are described with reference to the drawings. In the following comparative example and respective embodiments, the same reference numerals are given to similar constituent elements.

COMPARATIVE EXAMPLE

First of all, the configuration and operation of the comparative example, particularly the generation of DC offset are described below.

Figure 2:
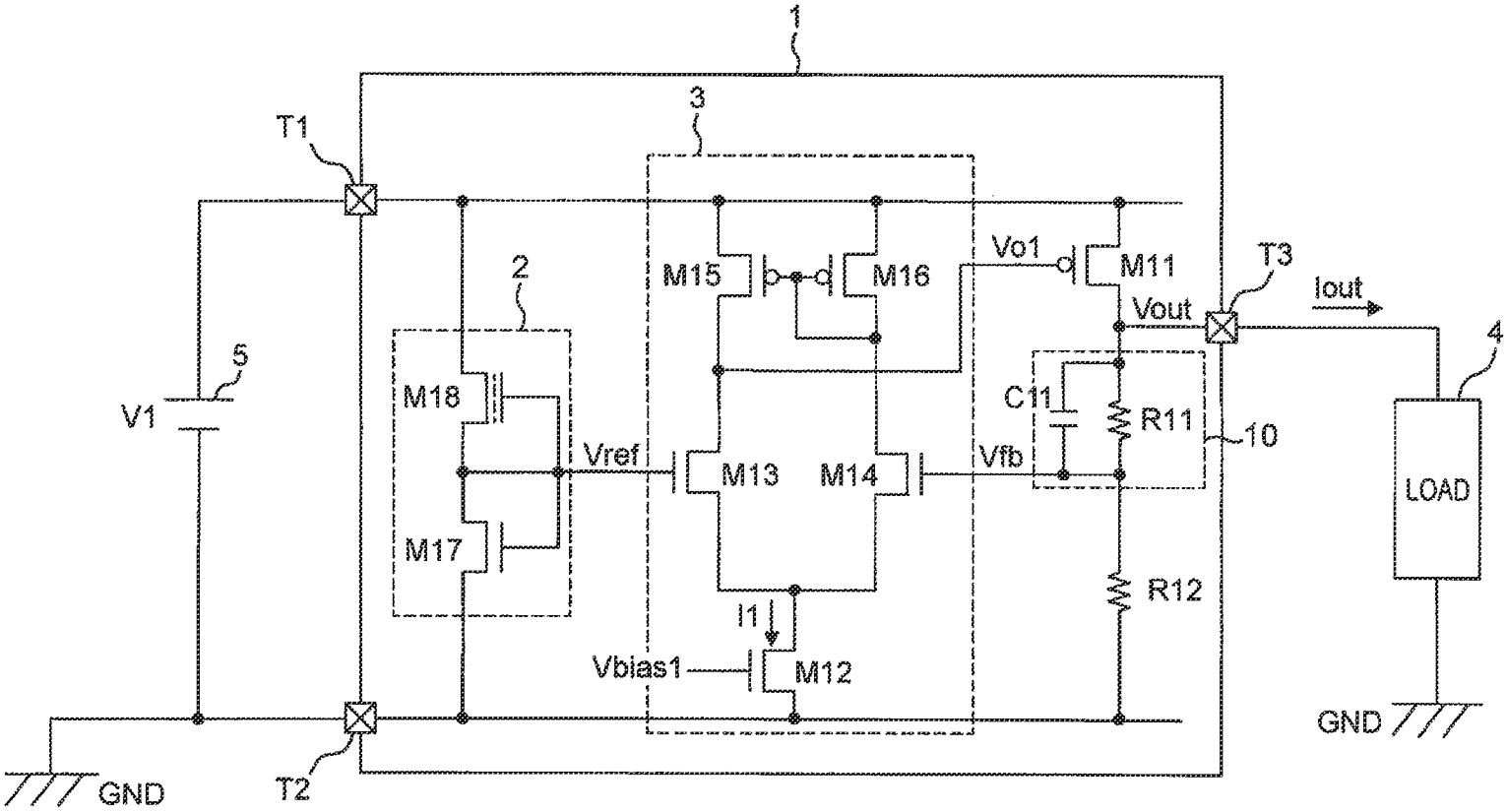
FIG. 2 is a detailed circuit diagram of the constant voltage generator circuit 1 of FIG. 1.

FIG. 1 is a circuit diagram showing a configuration of a constant voltage generator circuit 1 according to a comparative example, and FIG. 2 is a detailed circuit diagram of the constant voltage generator circuit 1 of FIG. 1. Referring to FIG. 1, the constant voltage generator circuit 1 has an input terminal T1, a ground terminal T2, and an output terminal T3. The constant voltage generator circuit 1 includes a reference voltage generator circuit 2, an operational amplifier 3 which is a so-called Op-Amp (differential amplifier), a P-channel metal oxide semiconductor (MOS) transistor M11, a feedback circuit 10, and a resistor $R_{12}$. In this case, the feedback circuit 10 is a parallel circuit of a voltage dividing resistor $R_{11}$ and a capacitor $C_{11}$.

Referring to FIG. 1, a MOS transistor M11, which is a driver transistor or output transistor, is connected between the input terminal T1 and the output terminal T3, and the ground terminal T2 is grounded. A series circuit of the voltage dividing resistors $R_{11}$ and $R_{12}$ is connected between the output terminal T3 and the ground terminal T2, and a divided voltage Vfb is used as a feedback voltage from a connection part between the resistors $R_{11}$ and $R_{12}$ to be outputted to a non-inverting input terminal of the operational amplifier 3. An output terminal of the operational amplifier 3 is connected to the gate of the MOS transistor M11, the source of the MOS transistor M11 is connected to the input terminal T1, and the drain of the MOS transistor M11 outputs an output voltage Vout and is connected to the output terminal T3 and one end of the feedback circuit 10. Further, the capacitor $C_{11}$ of a phase compensation capacitance is connected between the feedback voltage Vfb and the output voltage Vout.

The reference voltage generator circuit 2 generates a predetermined reference voltage Vref based on a voltage between the input terminal T1 and the ground terminal T2, and outputs the reference voltage to the inverting input terminal of the operational amplifier 3.

In the reference voltage generator circuit 2 of FIG. 2, the source of a MOS transistor M17 is connected to the ground terminal T2, and the gate and drain of the MOS transistor M17 are connected to each other. The drain of a MOS transistor M18 is connected to the input terminal Ti, and the source and gate of the MOS transistor M18 are connected to the gate and source of the MOS transistor M17. In this case, the voltage at a connection point between the gate and the source of the MOS transistor M17 is outputted as the reference voltage Vref to the non-inverting input terminal of the operational amplifier.

The reference voltage Vref is inputted to the gate of a MOS transistor M13 that configures the inverting input terminal of the operational amplifier 3, and a divided voltage Vfb is inputted to the gate of a MOS transistor M14 that configures the non-inverting input terminal of the operational amplifier 3. The MOS transistors M13 and M14 configure a differential pair, and MOS transistors M15 and M16 configure a current mirror circuit to form a load of the differential pair.

Further, in the MOS transistors M15 and M16, each of the sources is connected to the input terminal T1 from which input is received, the gates are connected to each other, and a connection part of the gates is connected to the drain of the MOS transistor M16. Further, the drain of the MOS transistor M16 is connected to the drain of the MOS transistor M14, and the drain of the MOS transistor M15 is connected to the drain of the MOS transistor M13 whose drains configure the output terminal of the operational amplifier 3 to output an output voltage Vol to the gate of the driver transistor M11.

The sources of the MOS transistors M13 and M14 are connected to each other and connected to the drain of a MOS transistor M12, a bias voltage Vbias1 is applied to the gate of the MOS transistor M12, and the source of the MOS transistor M12 is grounded.

In the constant voltage generator circuit 1 configured as described above, the operational amplifier 3 amplifies the voltage difference between the reference voltage Vref and the divided voltage Vfb and outputs the voltage difference to the gate of the driver transistor M11. Then, by controlling an output current Tout output from the driver transistor M11, the output voltage Vout is controlled to be a predetermined voltage.

Figure 3:
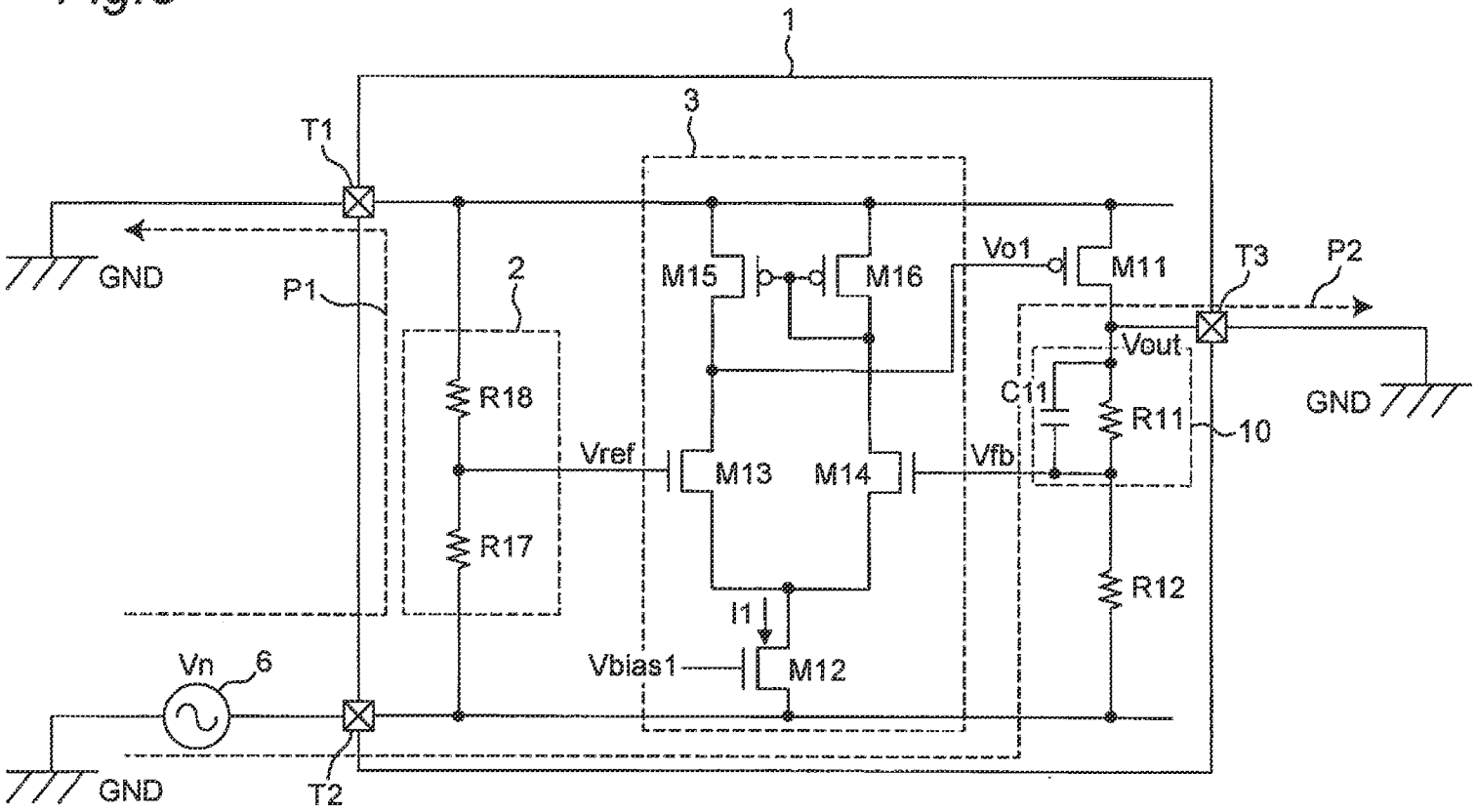
FIG. 3 is a small signal equivalent circuit diagram showing noise paths P1 and P2 in the constant voltage generator circuit 1 of FIG. 2.

FIG. 3 is a small signal equivalent circuit diagram showing noise paths P1 and P2 in the constant voltage generator circuit 1 of FIG. 2, and is a diagram for explaining noise propagation when high-frequency noise is radiated to the substrate.

The high-frequency noise is an AC signal, and in the small signal equivalent circuit, both the input terminal T1 and the output terminal T3 can be regarded as grounded as shown in FIG. 3. Further, the transistors M17 and M18 configuring the reference voltage generator circuit 2 in the comparative example of FIG. 2 can be regarded as the equivalent circuit of resistors R17 and R18, and because the resistor R17 is a transistor that is in saturated connection, the resistor R17 has a resistance value generally smaller than that of the resistor R18.

When a high-frequency noise voltage Vn is generated at the substrate voltage potential, the reference voltage Vref is expressed by the following equation:

$$Vref = Vn \times R_{18}/(R_{17}+R_{18}) \tag{1}$$

That is, the noise voltage of Equation (1) propagates to the reference voltage Vref. In this case, because the resistor $R_{18}$ is sufficiently larger than the resistor $R_{17}$ as described above, the signal of the noise voltage Vn propagates to the gate of the MOS transistor M13.

On the other hand, the gate of the MOS transistor M14 is a node to which the reference voltage Vref is applied, and the output current Tout flows to the output terminal T3 via the resistor $R_{12}$ connected between the substrate voltage potential (ground voltage potential) and the feedback voltage Vfb, and the resistor $R_{11}$ and the capacitor $C_{11}$ as the phase compensation capacitance connected between the output voltage Vout and the feedback voltage Vfb.

Figure 4:
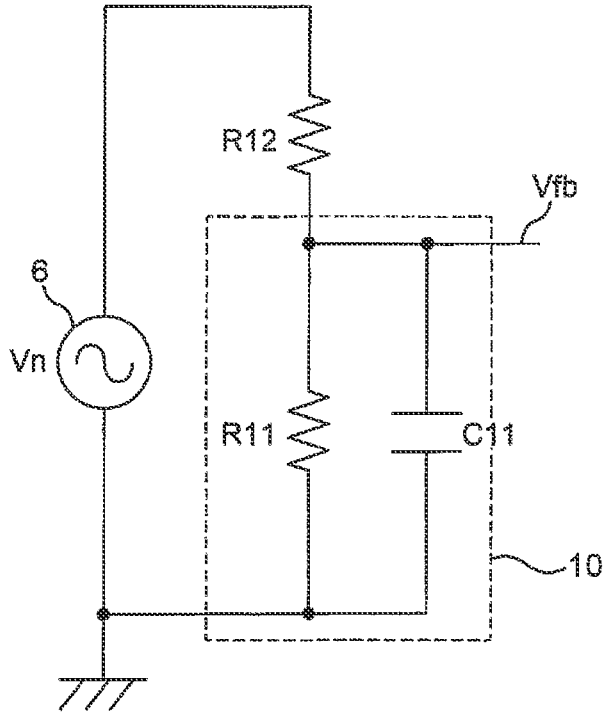
FIG. 4 is a small signal equivalent circuit diagram showing the noise path P2 of a substrate noise voltage Vn in the constant voltage generator circuit 1 of FIG. 3.

FIG. 4 is a small signal equivalent circuit diagram showing the noise path P2 of the substrate noise voltage Vn in the constant voltage generator circuit 1 of FIG. 3. Referring to FIG. 4, the feedback voltage Vfb including the noise voltage Vn propagating to the feedback voltage Vfb is expressed by the following equation:

$$V_{fb} = \frac{1}{\left(1 + \frac{R_{12}}{R_{11}}\right) + j\omega C_{11} R_{12}} V_n. \tag{2}$$

As is apparent from the term $j\omega C_{11}R_{12}$ in the denominator of Equation (2), the higher the frequency of the substrate noise Vn, the larger the absolute value of the denominator, and the noise amplitude propagating to the feedback voltage Vfb becomes 0 V. This indicates that the noise generated in the substrate does not propagate to the feedback voltage Vfb. As a result, a difference is generated in the noise voltage propagating between the reference voltage Vref and the feedback voltage Vfb, and the DC offset described above is generated.

First Embodiment

Figure 5:
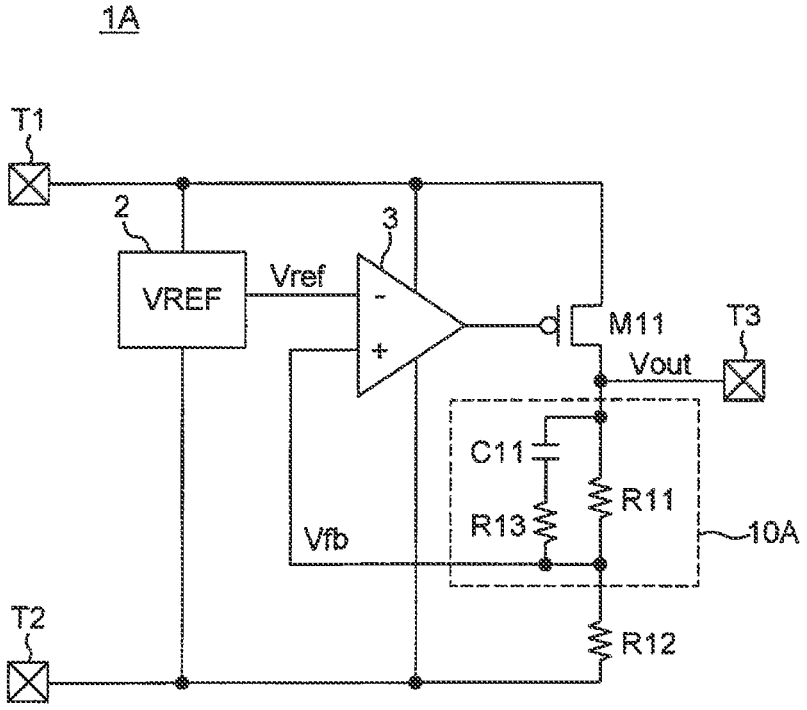
FIG. 5 is a circuit diagram showing a configuration example of a constant voltage generator circuit 1A according to a first embodiment.

FIG. 5 is a circuit diagram showing a configuration example of a constant voltage generator circuit 1A according to a first embodiment. Referring to FIG. 5, the constant voltage generator circuit 1A is different from the constant voltage generator circuit 1 of FIG. 1 in such a point that a feedback circuit 10A is provided instead of the feedback circuit 10.

The present embodiment provides a constant voltage generator circuit that can prevent the DC offset from generating, in a constant voltage generator circuit including a differential amplifier circuit having a feedback circuit, when the high-frequency noise components outside the loop frequency band of the feedback system are inputted, by substantially matching each of the noise amplitudes propagating to the inverting input and the non-inverting input. In the present embodiment, in particular, in the feedback circuit 10A, each of the noise amplitudes propagating to the inverting input and the non-inverting input can be substantially matched in the high-frequency region outside the loop frequency band, by connecting a resistor $R_{13}$ in series with a capacitor $C_{11}$ which is the phase compensation capacitance.

Figure 6:
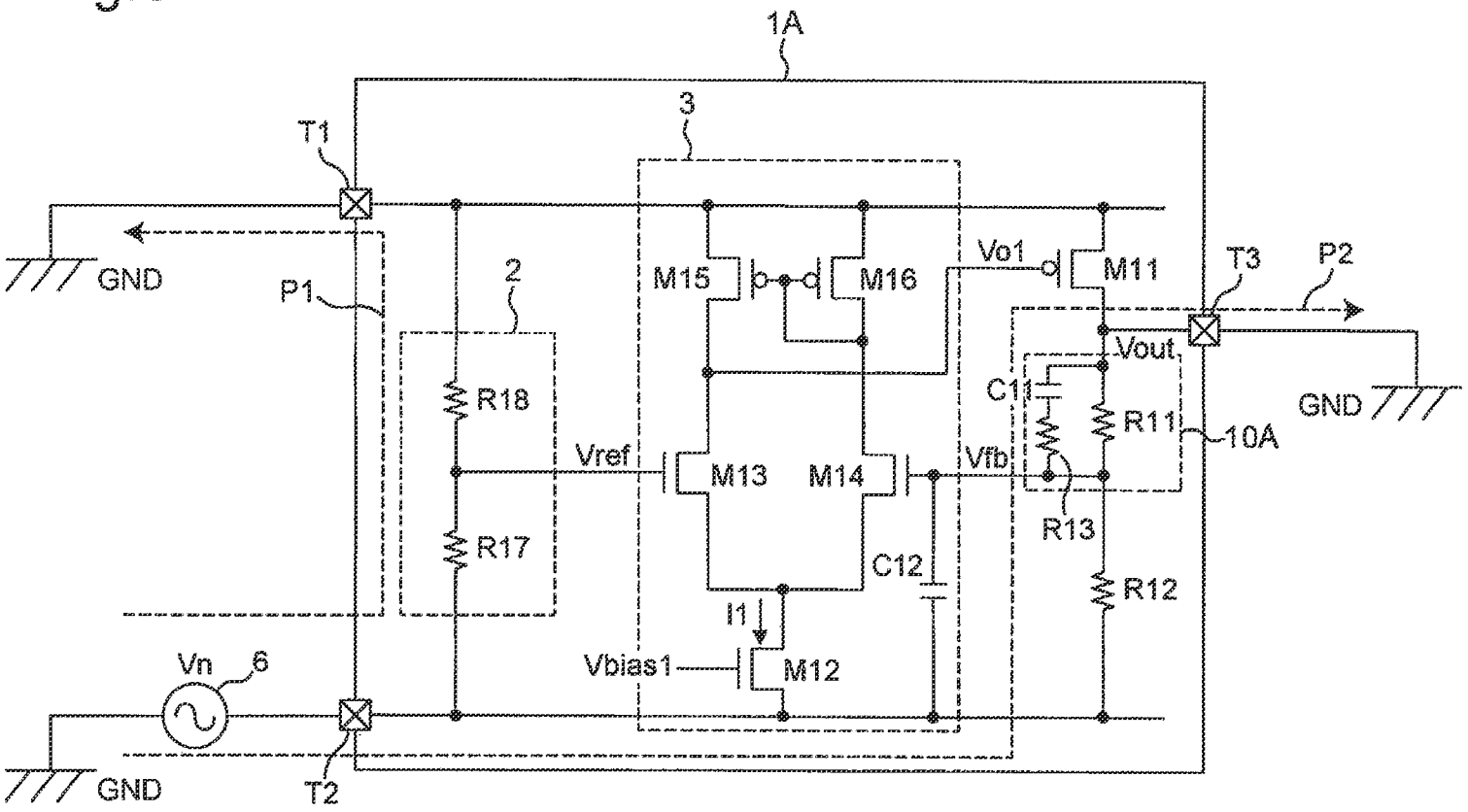
FIG. 6 is a small signal equivalent circuit diagram showing noise paths P1 and P2 in the constant voltage generator circuit 1A of FIG. 5.

FIG. 6 is a small signal equivalent circuit diagram showing noise paths P1 and P2 in the constant voltage generator circuit 1A of FIG. 5, and is a circuit diagram that describes noise propagation when a high-frequency noise voltage Vn (including high frequency noise components) is superimposed on the substrate voltage potential. As shown in FIG. 6, a noise voltage Vna of the following equation propagates to the gate of a MOS transistor M13 (having a reference voltage Vref) in a manner similar to that of FIG. 3:

$$Vna = Vn \times R_{18}/(R_{17}+R_{18}).$$

In this case, because a resistor $R_{18}$ is sufficiently larger than a resistor $R_{17}$, a signal having an approximate noise voltage Vn propagates to the gate of the MOS transistor M13.

On the other hand, at the gate of a MOS transistor M14, current flows to a terminal T3 via a resistor $R_{12}$ connected between the substrate voltage potential and a feedback voltage Vfb, a parasitic capacitance $C_{12}$, and the feedback circuit 10A (including a resistor $R_{11}$ connected between an output voltage Vout and the feedback voltage Vfb, the capacitor $C_{11}$ which is a phase compensation capacitance, and the resistor $R_{13}$ connected in series with the capacitor $C_{11}$).

Figure 7:
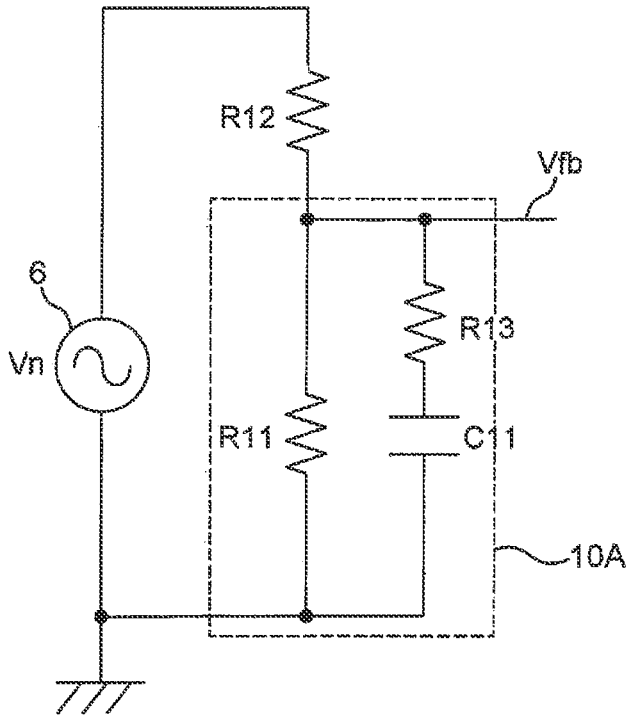
FIG. 7 is a small signal equivalent circuit diagram showing the noise path P2 of a substrate noise voltage Vn in the constant voltage generator circuit 1A of FIG. 6.

In this case, when an angular frequency $\omega_n$ of the noise voltage Vn to the substrate voltage potential satisfies the following equation, the propagation path of the noise voltage Vn mainly flows to the output terminal T3 via the resistor $R_{12}$, and an equivalent circuit diagram of the noise path P2 at this time is shown in FIG. 7:

$$\omega_n \ll \frac{1}{R_{12}C_{12}}. \tag{3}$$

That is, FIG. 7 is a small signal equivalent circuit diagram showing the noise path P2 of the substrate noise voltage Vn in the constant voltage generator circuit 1A of FIG. 6.

For example, assuming that the resistance value of the resistor $R_{12}$ is one MΩ and the capacitance of the capacitor $C_{12}$ is 100 fF, the case in which the frequency of the noise voltage Vn in Equation (3) is lower than 1.59 MHz is the target. At this time, the noise voltage Vn propagating to the feedback voltage Vfb is expressed by the following equation:

$$V_{fb} = \frac{1}{\left(1+\frac{R_{12}}{R_{11}}\right)+\frac{j\omega_n C_{11}R_{12}}{1+j\omega_n C_{11}R_{13}}}V_n. \tag{4}$$

Further, the case in which the condition of the angular frequency of the substrate noise voltage Vn is the following equation is considered:

$$\omega_n \gg \frac{1}{R_{13}C_{11}}. \tag{5}$$

At this time, Equation (4) is expressed by the following equation:

$$V_{fb} = \frac{1}{1+\frac{R_{12}}{R_{11}}+\frac{R_{12}}{R_{13}}}V_n. \tag{6}$$

Next, the resistance values of the resistors $R_{11}$, $R_{12}$, and $R_{13}$ are set to satisfy the relationship of the following equation:

$$R_{13} \gg R_{12},\ R_{11} \gg R_{12} \tag{7}$$

At this time, Equation (6) is expressed by the following equation:

$$V_{fb} \approx V_n \tag{8}$$

Therefore, in the feedback voltage Vfb, the substrate noise voltage propagating to the node of the feedback voltage Vfb becomes Vn, which substantially coincides with the substrate noise Vn propagating to the reference voltage Vref. As a result, because the above-described DC offset is not generated, fluctuations in the output voltage can be suppressed.

Next, the noise path P2 in the case in which the angular frequency of the substrate noise Vn satisfies the following equation is the current mainly flowing to the terminal T3 via the parasitic capacitance $C_{12}$. A small signal equivalent circuit diagram at this time is shown in FIG. 8.

Figure 8:
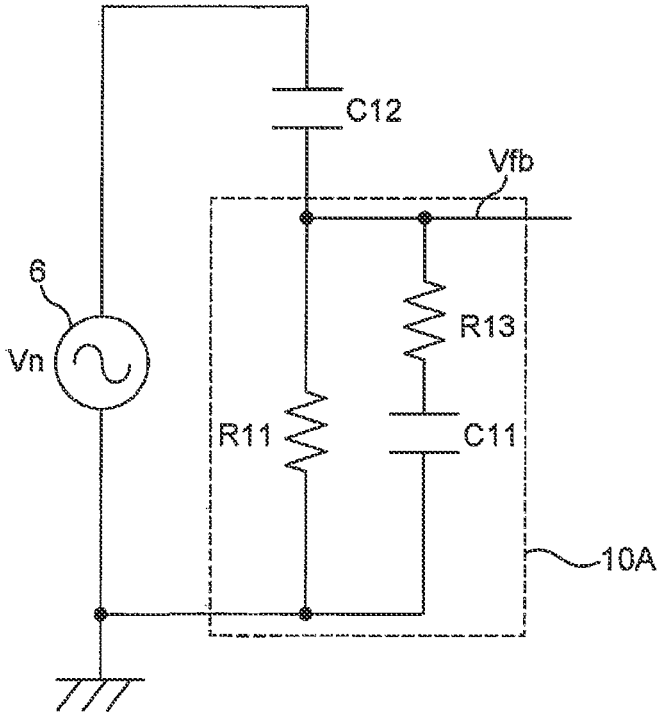
FIG. 8 is a small signal equivalent circuit diagram showing the noise path P2 of the substrate noise voltage Vn when a frequency of the substrate noise voltage Vn is in a predetermined condition in the constant voltage generator circuit 1A of FIG. 6.

FIG. 8 is a small signal equivalent circuit diagram showing the noise path P2 of the substrate noise voltage Vn in the case in which the frequency of the substrate noise voltage Vn is in the condition of the following equation in the constant voltage generator circuit 1A of FIG. 6:

$$\omega_n \gg \frac{1}{R_{12}C_{12}}. \tag{9}$$

At this time, the noise voltage Vfb propagating to the node of the feedback voltage Vfb is expressed by the following equation:

$$V_{fb} = \frac{1}{1 + \frac{1}{j\omega R_{11}C_{12}} + \frac{1}{j\omega R_{13}C_{12} + \frac{C_{12}}{C_{11}}}} V_n. \tag{10}$$

Usually at this time, because the capacitor $C_{11}$ which is the phase compensation capacitance is sufficiently larger than the parasitic capacitance $C_{12}$, the following relationship is established:

$$C_{11} \gg C_{12} \tag{11}$$

Further, the parameter values $R_{11}$, $R_{13}$, and $C_{12}$ that satisfy the following equations are set:

$$\omega_n \gg \frac{1}{R_{11}C_{12}} \tag{12}$$

$$\omega_n \gg \frac{1}{R_{13}C_{12}}.$$

By satisfying the above Equations (11) and (12), the Equation (10) is expressed by the following equation:

$$V_{fb} \approx V_n \tag{13}$$

As a result, the DC offset described above is not generated.

Next, in order to show that the addition of the resistor $R_{13}$ does not affect the conventional feedback loop circuit as shown in FIG. 5, the influence on the operating band of the constant voltage generator circuit is described below.

Figure 9:
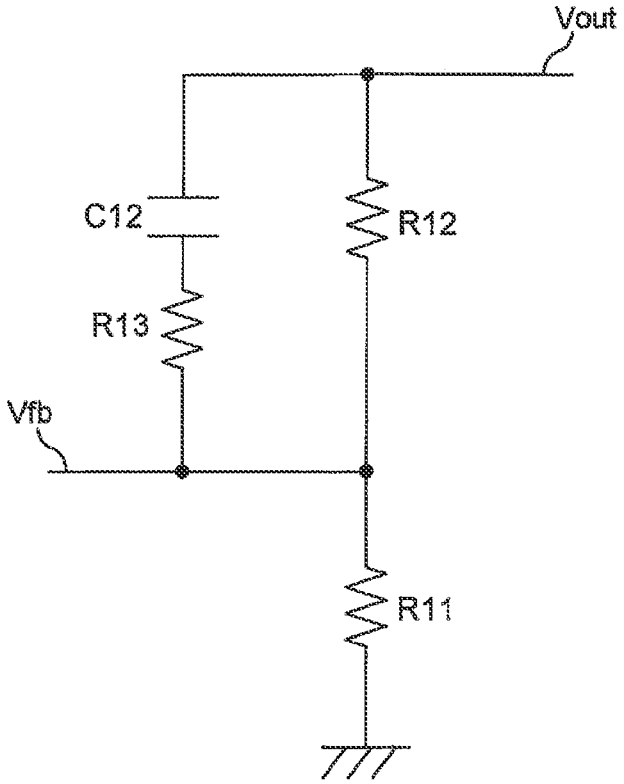
FIG. 9 is a circuit diagram of a phase compensation circuit of the constant voltage generator circuit 1A of FIG. 6.

FIG. 9 is a circuit diagram of a phase compensation circuit of the constant voltage generator circuit 1A of FIG. 6. In the configuration of the phase compensation circuit shown in FIG. 9, a zero point is generated at the following angular frequency $\omega_z$, which has the effect of raising the phase:

$$\omega_z = \frac{1}{C_{11}(R_{11} + R_{13})}. \tag{14}$$

At this time, if the angular frequency of, $$\omega = \frac{1}{C_{11}R_{13}}, \tag{15}$$

is outside the operating band of the constant voltage generator circuit 1A, the angular frequency does not act as phase compensation within the operating band, but functions only for the effect of increasing the high-frequency noise immunity. That is, the high-frequency noise components having the substrate noise voltage Vn have frequency components equal to or more than the feedback loop frequency of the feedback circuit 10. The phase compensation at this time is determined by the following phase constant before the resistor $R_{13}$ is added:

$$\omega_z = \frac{1}{C_{11}R_{11}}. \tag{16}$$

According to the constant voltage generator circuit according to the first embodiment configured as described above, by connecting the predetermined resistor in series to the phase compensation capacitance in the feedback circuit 10A, each of the noise amplitudes propagating to the inverting input and the non-inverting input can be substantially matched, in the high-frequency region exceeding the operating band of the constant voltage generator circuit. Therefore, the generation of the DC offset can be prevented, and the malfunction of the IC can be prevented.

Second Embodiment

Figure 10:
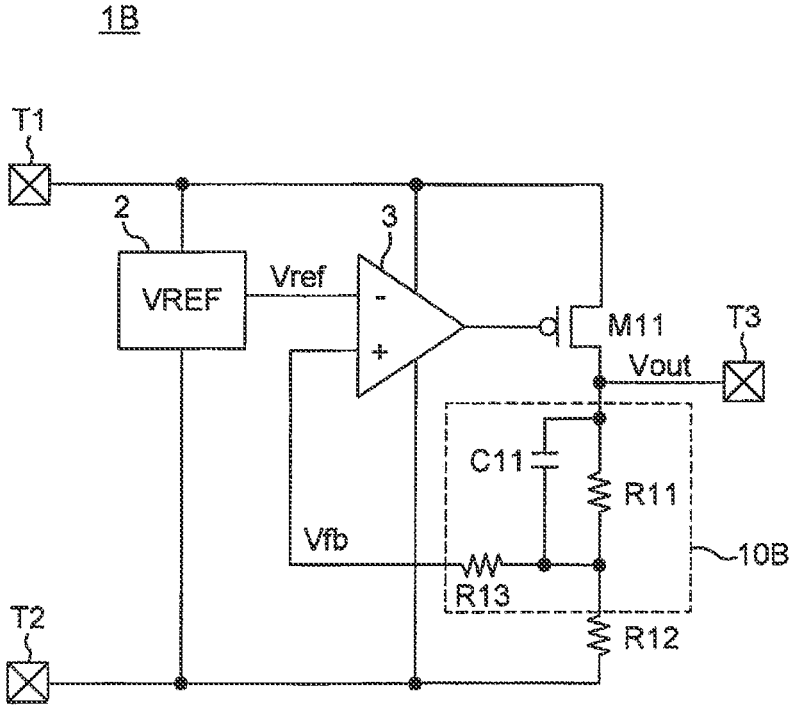
FIG. 10 is a circuit diagram showing a configuration example of a constant voltage generator circuit 1B according to a second embodiment.

FIG. 10 is a circuit diagram showing a configuration example of a constant voltage generator circuit 1B according to a second embodiment. Referring to FIG. 10, the constant voltage generator circuit 1B according to the second embodiment is characterized in that a feedback circuit 10B is provided in place of the feedback circuit 10A as compared with the constant voltage generator circuit 1A of FIGS. 5 and 6. The feedback circuit 10B is configured by connecting a resistor R13 in series with a series circuit of a resistor $R_{11}$ and a capacitor $C_{11}$.

When the condition of Equation (9) in the first embodiment is satisfied, a noise current flows through a parasitic capacitance $C_{12}$. At this time, the configuration of the feedback circuit 10B according to the second embodiment has been devised as a method of superimposing a substrate noise Vn on the voltage potential of a feedback voltage Vfb.

Figure 11:
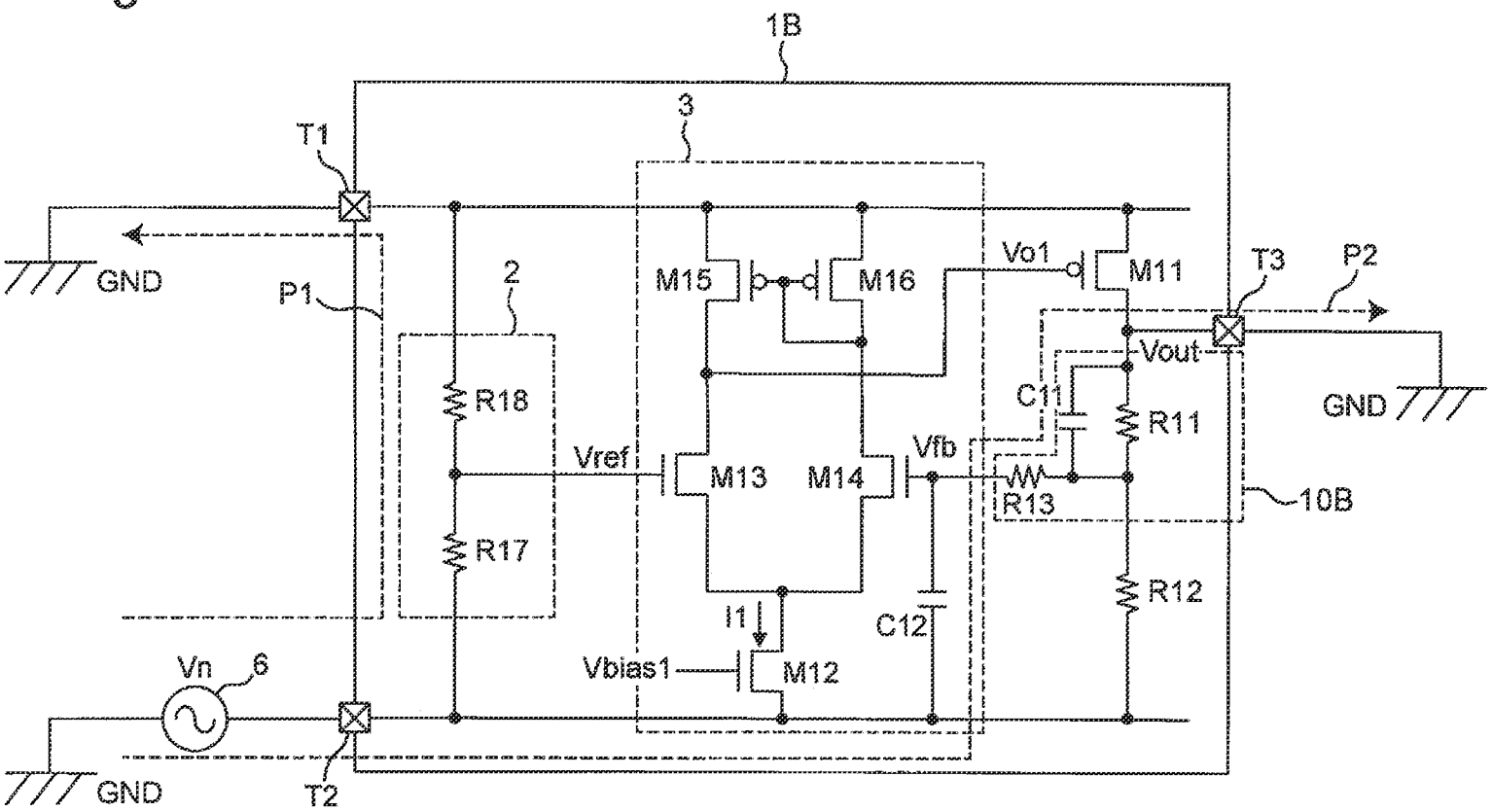
FIG. 11 is a small signal equivalent circuit diagram showing noise paths P1 and P2 in the constant voltage generator circuit 1B of FIG. 10.
Figure 12:
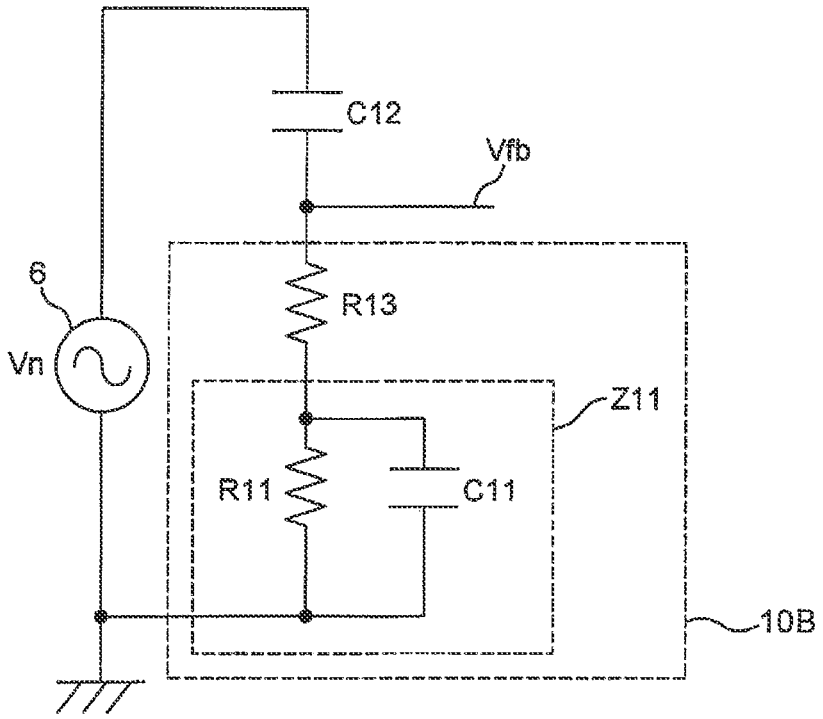
FIG. 12 is a small signal equivalent circuit diagram showing the noise path P2 of a substrate noise voltage Vn in the constant voltage generator circuit 1B of FIG. 10.

FIG. 11 is a small signal equivalent circuit diagram showing noise paths P1 and P2 in the constant voltage generator circuit 1B of FIG. 10. Further, FIG. 12 is an equivalent circuit diagram showing the noise path P2 of the substrate noise voltage Vn in the constant voltage generator circuit 1B of FIG. 10. Referring to FIG. 12, a combined impedance of the resistor $R_{11}$ and the capacitor $C_{11}$ is assumed to be $Z_{11}$. At this time, the feedback voltage Vfb is expressed by the following equation:

$$V_{fb} = \frac{R_{13} + Z_{11}}{R_{13} + Z_{11} + \frac{1}{j\omega C_{12}}} V_n. \tag{17}$$

At this time, if the following equation holds:

$$R_{13} \gg \frac{1}{\omega C_{12}}. \tag{18}$$

Equation (17) is expressed by the following equation:

$$V_{fb} \approx V_n \tag{19}$$

Therefore, the feedback voltage Vfb becomes equal to the substrate noise Vn propagating to the feedback voltage Vfb, and the DC offset is not generated.

According to the constant voltage generator circuit according to the second embodiment configured as described above, by connecting a predetermined resistor in series to the series circuit of the phase compensation capacitance and the resistor in the feedback circuit 10A, each of the noise amplitudes propagating to the inverting input and the non-inverting input can be substantially matched, in the high-frequency region exceeding the operating band of the constant voltage generator circuit. Therefore, the generation of the DC offset can be prevented and the malfunction of the IC can be prevented.

Summary of Embodiments

As a summary of the above embodiments 1 and 2, Table 1 shows a condition correspondence table, the condition satisfying the feedback voltage Vfb=the substrate noise voltage Vn.

TABLE 1

| FREQUENCY | $\omega_n < \frac{1}{R_{12}C_{12}}$ | | $\frac{1}{R_{12}C_{12}} < \omega_n$ |
|---|---|---|---|
| EMBODIMENT | FIG. 5 | | FIG. 10 |
| CONDITION THAT SATISFIES Vfb = Vn | $R_{13} > R_{12}$<br>$R_{11} > R_{12}$ | $C_{11} > C_{12}$<br>$R_{13} < \frac{1}{\omega_n C_{12}}$<br>$R_{11} < \frac{1}{\omega_n C_{12}}$ | $R_{13} > \frac{1}{\omega_n C_{12}}$ |

EXAMPLES

Figure 13:
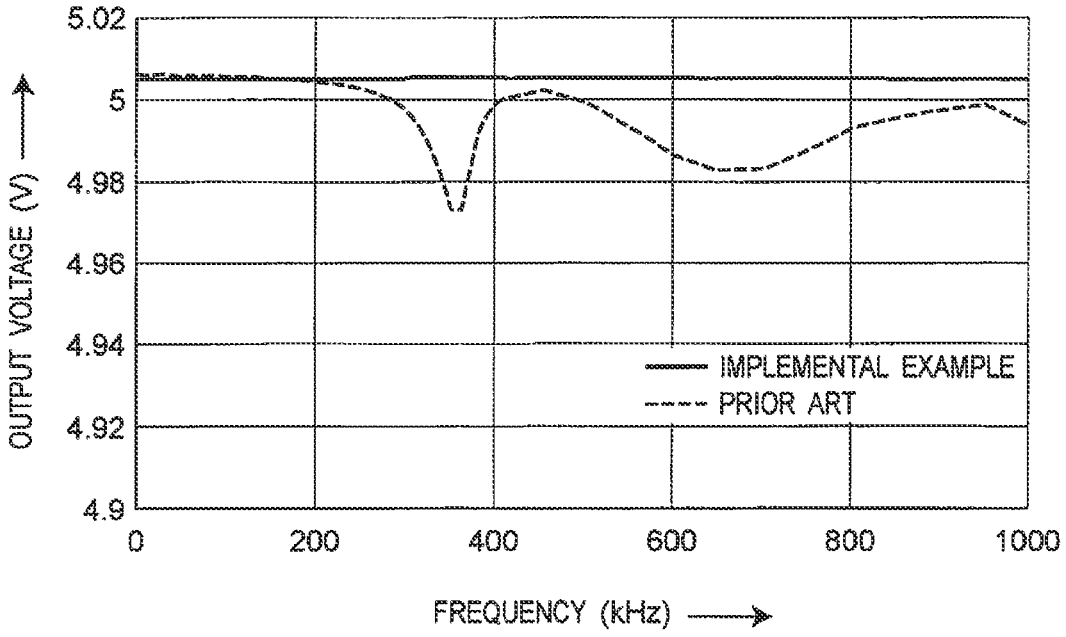
FIG. 13 shows an experimental result of a radio wave irradiation test for a constant voltage generator circuit of an implementation example and a conventional example, and is a graph showing frequency characteristics of an output voltage Vout.

FIG. 13 shows an experimental result of a radio wave irradiation test for the constant voltage generator circuits of an example and a conventional example, and is a graph showing the frequency characteristics of an output voltage Vout. In this case, the conventional example is a constant voltage generator circuit related to a product manufactured by the applicant, and the example is an R1525 type constant voltage generator circuit manufactured by the applicant.

FIG. 13 shows fluctuations of the constant voltage generator circuit when the frequency of the radio wave is changed from 1 MHz to 1 GHz in the radio wave irradiation test. As is apparent from FIG. 13, in the conventional constant voltage generator circuit, the output voltage drops due to the influence of the DC offset caused by the superposition of harmonic noise components in the band of 100 kHz or more, which is the operating band of the constant voltage generator circuit. On the other hand, it can be seen that the decrease in output voltage is not generated in the constant voltage generator circuit of the example.

Difference from Comparison Example

The comparative example described in Patent Document 1 is characterized in that the low-pass filter for limiting high-frequency noise components is provided in order to improve high-frequency noise immunity. On the other hand, the present embodiment is intended to provide the constant voltage generator circuit that includes the differential amplifier circuit having the feedback circuit and can prevent the DC offset from generating even when the high-frequency noise components outside the loop frequency band of the feedback circuit are inputted. The constant voltage generator circuit does not include a low-pass filter and has a completely different configuration.

INDUSTRIAL APPLICABILITY

As mentioned above in detail, according to the constant voltage generator circuit of the present invention, even when the high-frequency noise components outside the loop frequency band of the feedback circuit are inputted in the constant voltage generator circuit including the differential amplifier circuit having the feedback circuit, the DC offset can be prevented from generating.

DESCRIPTION OF REFERENCE CHARACTERS

1, 1A, and 1B CONSTANT VOLTAGE GENERATOR CIRCUIT
2 REFERENCE VOLTAGE GENERATOR CIRCUIT
3 OPERATIONAL AMPLIFIER
4 LOAD
5 CONSTANT VOLTAGE SOURCE
6 NOISE VOLTAGE SOURCE
10, 10A, and 10B FEEDBACK CIRCUIT
$C_{11}$ CAPACITOR
M11 to M18 MOS TRANSISTOR
$R_{11}$ to $R_{13}$ RESISTOR
T1 INPUT TERMINAL
T2 GROUND TERMINAL
T3 OUTPUT TERMINAL
$Z_{11}$ COMBINED IMPEDANCE

PRIOR ART DOCUMENT

Patent Document

[Patent Document 1] Japanese Patent Laid-open Publication No. JP2017-068471A

The invention claimed is:

1. A constant voltage generator circuit comprising:

an operational amplifier including a feedback circuit having a first resistor, the operational amplifier generating a feedback voltage generated by dividing an output voltage between an output terminal and a substrate voltage potential of the constant voltage generator circuit by the first resistor and a second resistor, the operational amplifier being configured to amplify a voltage potential difference between a predetermined reference voltage and the feedback voltage and to output a control voltage; and an output transistor that controls an output voltage based on the control voltage from the operational amplifier, wherein the feedback circuit is further configured to superimpose high-frequency noise components from the substrate voltage potential onto the feedback voltage, wherein the high-frequency noise components have frequency components equal to or more than a feedback loop frequency of the feedback circuit.

2. The constant voltage generator circuit as claimed in claim 1, wherein the feedback circuit is configured to substantially match respective noise amplitudes propagating to an inverting input and a non-inverting input of the operational amplifier with each other, by superimposing the high-frequency noise components from the substrate voltage potential onto the feedback voltage.

3. The constant voltage generator circuit as claimed in claim 1, wherein the feedback circuit comprises a parallel circuit connected in parallel to the first resistor and allowing the high-frequency noise components to pass through, and wherein the parallel circuit is configured by connecting a third resistor and a capacitor in series.

4. The constant voltage generator circuit as claimed in claim 1, wherein the feedback circuit comprises a capacitor that is connected in parallel to the first resistor and allows the high-frequency noise components to pass through, wherein the feedback circuit is inserted between the output terminal and the non-inverting input of the operational amplifier, and wherein the feedback circuit further comprises a fourth resistor having one end connected to the non-inverting input of the operational amplifier and another end connected to the first resistor.

* * * * *